US006042485A

United States Patent [19]

Cheng

[11] Patent Number: 6,042,485

[45] Date of Patent: Mar. 28, 2000

[54] VIBRATION DAMPING DEVICE

[75] Inventor: Michael H. L. Cheng, Simi Valley, Calif.

[73] Assignee: Harrison Sports, Inc., Pacoima, Calif.

[21] Appl. No.: 09/015,015

[22] Filed: Jan. 28, 1998

[51] Int. Cl.[7] ..... A63B 53/08

[52] U.S. Cl. ..... 473/318; 473/520

[58] Field of Search ..... 473/316–323, 473/297, 300, 302, 303, 521, 520, 564, 565, 566, 567, 568

[56] References Cited

U.S. PATENT DOCUMENTS

| | | | |
|---|---|---|---|
| 2,023,131 | 12/1935 | Gibson | 473/318 |
| 2,446,622 | 8/1948 | Turner | 473/302 |
| 3,606,326 | 9/1971 | Sparks | 473/300 |
| 4,128,242 | 12/1978 | Elkins, Jr. . | |
| 4,415,156 | 11/1983 | Jorgensen . | |
| 5,294,119 | 3/1994 | Vincent et al. . | |
| 5,297,791 | 3/1994 | Negishi . | |
| 5,308,062 | 5/1994 | Hogan | 473/319 |
| 5,362,046 | 11/1994 | Sims . | |
| 5,569,097 | 10/1996 | Veux et al. . | |
| 5,653,643 | 8/1997 | Falone | 473/300 |
| 5,683,308 | 11/1997 | Monette | 473/318 |
| 5,692,971 | 12/1997 | Williams | 473/318 |
| 5,718,643 | 2/1998 | Wright | 473/297 |
| 5,902,656 | 5/1999 | Hwang | 428/36.91 |

*Primary Examiner*—Jeanette Chapman
*Assistant Examiner*—Stephen L. Blau
*Attorney, Agent, or Firm*—Henricks, Slavin & Holmes LLP

[57] ABSTRACT

A vibration damping device including an elastic main body portion and a plurality of damping members. Each of the damping members have at least a portion thereof within the elastic main body portion and at least one of the damping members is radially spaced from the longitudinal axis of the elastic main body portion.

28 Claims, 8 Drawing Sheets

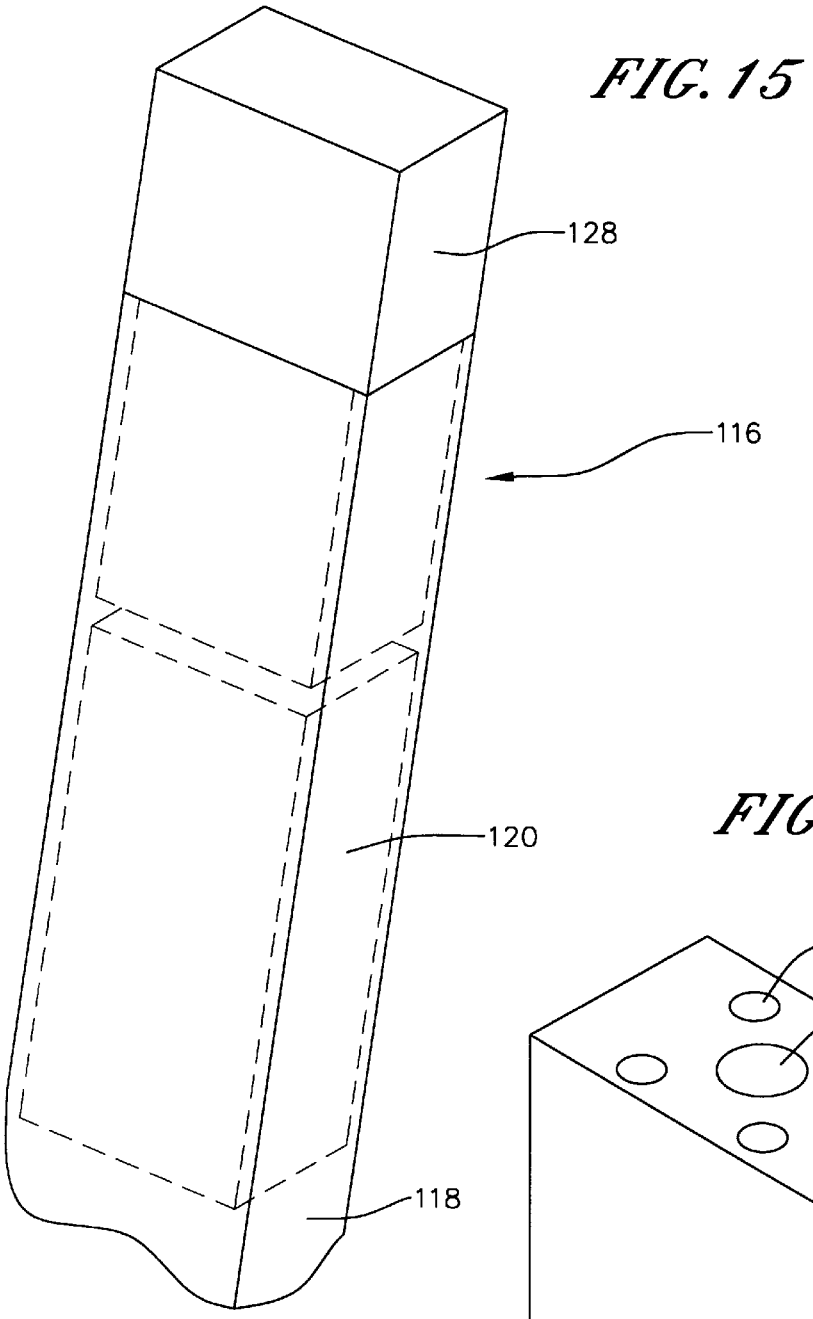
FIG. 15
FIG. 16
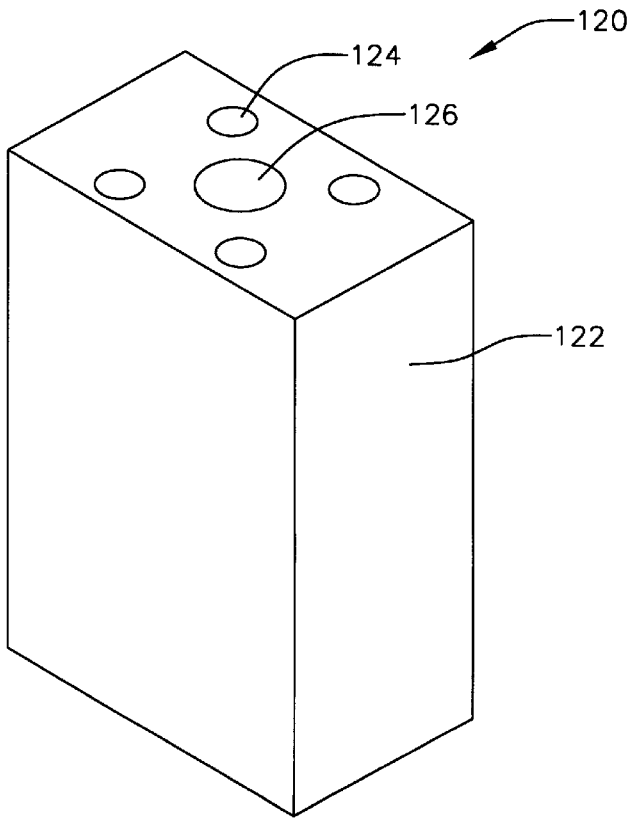

VIBRATION DAMPING DEVICE

BACKGROUND OF THE INVENTION

1. Field of Invention

The present invention is generally directed to vibration damping devices and, more particularly, to vibration damping devices which may be used in conjunction with golf clubs, baseball and softball bats, tennis rackets, hammers and other hand held devices which are designed to strike an object.

2. Description of the Related Art

There are many hand held devices which are used to strike objects. In the area of sports, for example, golf clubs, baseball and softball bats, and tennis rackets are used to strike golf balls, baseballs, softballs and tennis balls, respectively. Carpentry is another area where hand held devices are used to strike objects. Here, hammers and mallets are used to strike objects such as nails and dowels. Each device includes a striking surface which is used to strike to the object, a handle (or grip section) which is held by the user and connecting section extending therebetween. Golf clubs, for example, include a club head that is used to strike the golf ball. The club head is secured to one end of a shaft, while a grip is provided on the other.

In each of these devices, vibrations are transmitted from the striking surface, through the connecting section, and to the user's hands after impact. In almost every instance, the striking surface will include a so-called sweet spot. When the user strikes the object with the sweet spot, impact generated vibrations are minimized. Conversely, when the user fails to strike the object with the sweet spot, the impact generated vibrations can be quite unpleasant and can even cause pain and injury. Although skilled athletes, carpenters, etc. will typically strike an object with the sweet spot, novices and others of lesser skill will frequently fail to do so.

A number of vibration damping devices have been introduced in order to protect people from the unpleasant and sometimes injurious vibrations that result from failure to strike objects properly. By way of example, U.S. Pat. No. 5,294,119 to Vincent et al. discloses a vibration damping device that may be placed around the exterior surface of a golf club shaft or against the interior surface of a hollow shaft. The device includes a rigid tube and a layer of damping material which contacts either the interior surface or the exterior surface of the shaft. U.S. Pat. No. 5,362,046 to Sims discloses a more effective vibration damping device. The Sims device is a plug that is inserted into the butt end of a baseball bat, golf club shaft or other device. The plug consists primarily of a support, a stem extending from the support along the longitudinal axis thereof, and a damper secured to the free end of the stem. Oscillation of the stem and damper dissipates energy before it reaches the user's hands.

SUMMARY OF THE INVENTION

The inventor herein has determined that conventional vibration damping devices which include an oscillating body tend to be relatively heavy. Thus, the use of conventional vibration damping devices can conflict with the goal of keeping certain devices, such as golf clubs and tennis rackets, as light as possible. In the case of golf clubs, for example, designers strive to eliminate every possible gram of weight from the shaft.

Accordingly, the general object of the present invention is to provide a vibration damping device which avoids, for practical purposes, the aforementioned problems. In particular, one object of the present invention is to provide a vibration damping device that includes an oscillating body, but which is lighter than conventional vibration damping devices that includes an oscillating body.

In order to a accomplish these and other objectives, a vibration damping device in accordance with a preferred embodiment of the present invention includes an elastic main body portion and a plurality of damping members. Each of the damping members have at least a portion thereof within the elastic main body portion and at least one of the damping members is radially spaced from the longitudinal axis of the elastic main body portion. The present invention provides a number of advantages over conventional devices. For example, the present invention is lighter than a conventional oscillating body-based vibration damping device with the same or comparable damping capability.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 15 is a partial perspective view of a hockey stick including a vibration damping device in accordance with a preferred embodiment of the present invention.

FIG. 16 is a perspective view of the vibration damping device shown in FIG. 15.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. For example, although the present invention is described below in the context of golf clubs, the invention is applicable to any and all hand held devices that are used to strike objects. The scope of the invention is defined solely by the appended claims. Additionally, some of the exemplary golf club shafts discussed herein are described in terms of the golfer's top and bottom hands. For a right-handed golfer, the right hand is typically the bottom hand, while the left hand is typically the bottom hand for a left-handed golfer.

Figure 1:
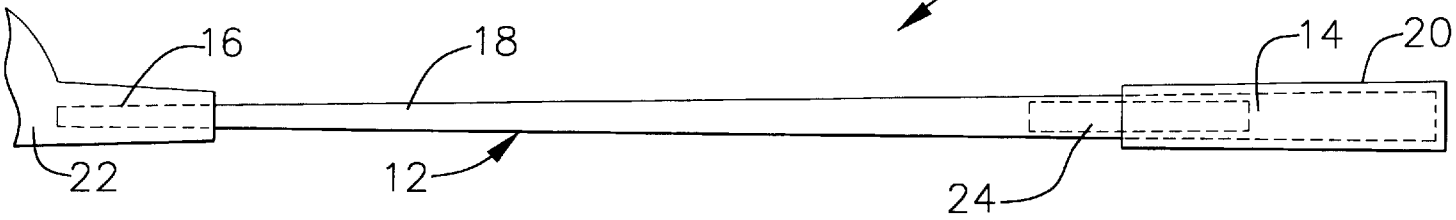
FIG. 1 is a side view of a golf club including a vibration damping device in accordance with a preferred embodiment of the present invention.

A golf club 10 including a shaft 12 having a grip section 14, a tip section 16 and a main body section 18 therebetween is illustrated, for example, in FIG. 1. Preferably, the grip section 14 supports a golf grip 20 and a club head 22 is secured to the tip section 16. In accordance with one embodiment of the present invention, a vibration damping device 24 is located within the interior of the shaft 12. Preferably, there is a press fit between the interior surface of the shaft 12 and the outer surface of the damping device 24. One portion of the vibration damping device 24 is located within the grip section 14 and the remaining portion is located within the main body section 18. Although this placement is preferable, the vibration damping device 24 may be placed at other locations within the grip section 14 or main body section 18. Additionally, or alternatively, a vibration damping device may also be located in the main body section 18 near the tip section 16.

Figure 3:
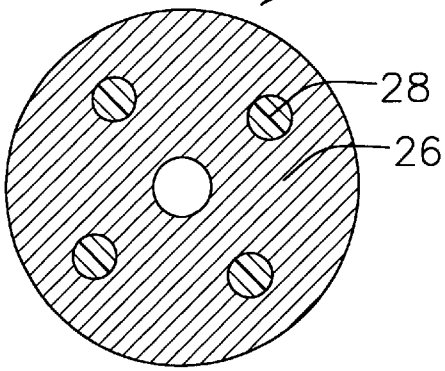
FIG. 3 is a section view taken along line 3—3 in FIG. 2.
Figure 2:
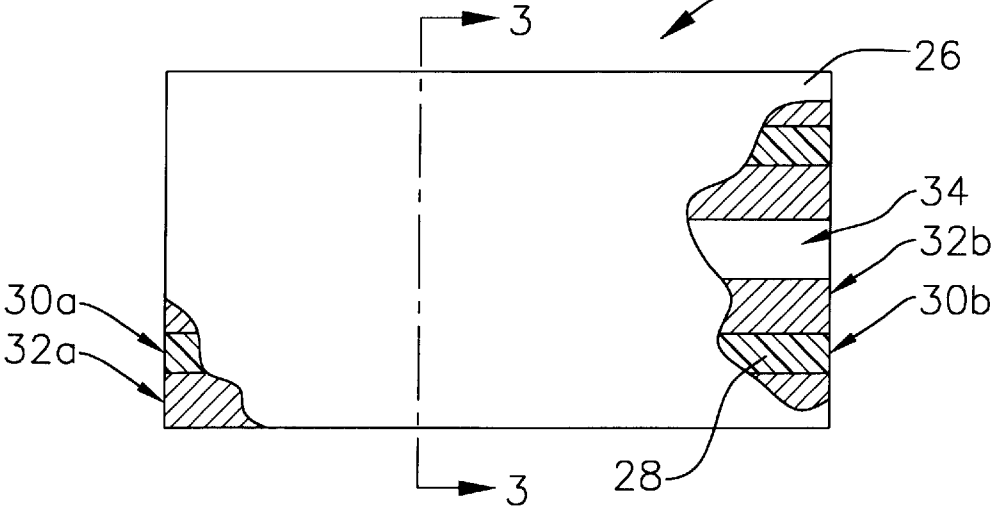
FIG. 2 is a side, partial section view of a vibration damping device in accordance with a preferred embodiment of the present invention.

As shown by way of example in FIGS. 2 and 3, the vibration damping device 24 includes an elastic main body portion 26 and a plurality of vibration damping members 28 within the main body portion. The vibration damping members 28 are radially spaced from the longitudinal axis of the main body portion 26. Although there are four vibration damping members 28 in the exemplary embodiment shown in FIGS. 2 and 3, the number of damping members may be varied to suit particular needs. Preferably, there should be at least two vibration damping members 28 and the damping members are preferably equally spaced around the main body portion 26.

Figure 6:
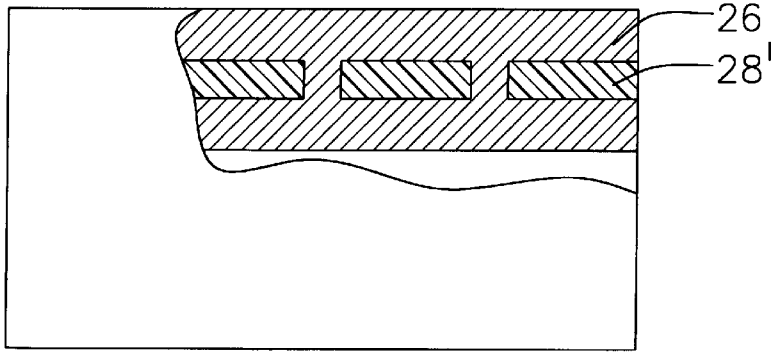
FIG. 6 is a side, partial section view of a vibration damping device in accordance with a still another preferred embodiment of the present invention.

The longitudinal ends 30*a* and 30*b* of the vibration damping members are preferably flush with the longitudinal ends 32*a* and 32*b* of the elastic main body portion. Alternatively, one or both of the vibration damping member ends 30*a* and 30*b* may extend beyond, or not extend to, the longitudinal ends 32*a* and 32*b* of the elastic main body portion. The exemplary vibration damping members 28 also extend continuously from longitudinal end 32*a* to longitudinal end 32*b*. However, a number of shorter damping members 28' may be used in place of one (or more) of the exemplary damping members 28, as is the case in the damping device 33 shown by way of example in FIG. 6. The shorter damping members may be linearly aligned, as shown, or slightly offset.

Figure 5:
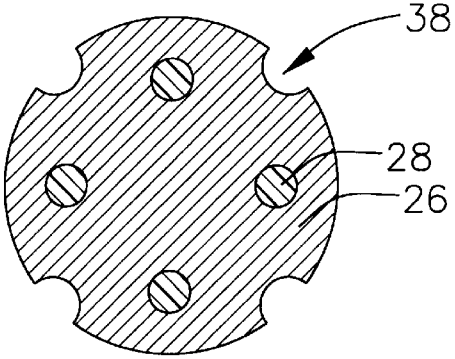
FIG. 5 is a section view taken along line 5—5 in FIG. 4.
Figure 4:
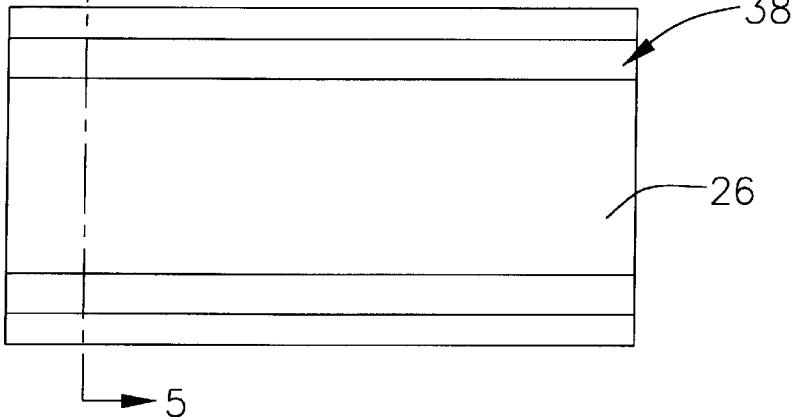
FIG. 4 is a side view of a vibration damping device in accordance with another preferred embodiment of the present invention.

In the preferred embodiment illustrated in FIGS. 2 and 3, an air passage 34 extends through the main body portion 26. The air passage 34 allows air to pass through the main body portion 26 when the damping device 24 is being inserted into the shaft of a golf club (or other device). Alternatively, and as shown by way of example in FIGS. 4 and 5, a vibration damping device 36 includes one or more groove-like air passages 38 located on the exterior surface of the main body portion 26.

Figure 7:
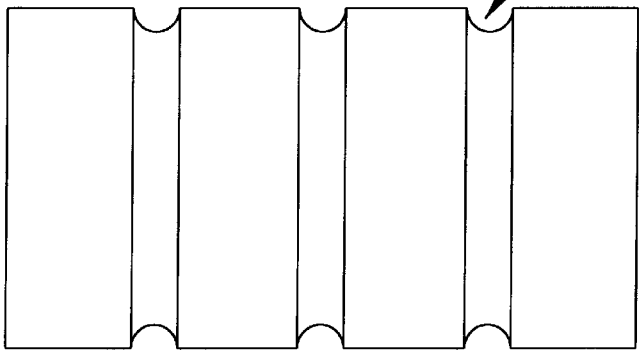
FIG. 7 is a side view of a vibration damping device in accordance with a yet another preferred embodiment of the present invention.

In accordance with another preferred embodiment of the present invention, and as shown by way of example in FIG. 7, the outer surface of a vibration damping device 40 includes a plurality grooves 42. The grooves, which extend around the perimeter of the damping device 40, perform the function of interrupting vibration waves. The interior of damping device 40 corresponds to the devices described above with reference to FIGS. 1–6.

The exemplary vibration damping devices illustrated in FIGS. 1–7 are substantially cylindrical, i.e. either perfectly cylindrical or slightly tapered so as to correspond to the slight taper of a golf club, in overall shape. However, not all golf club shafts have a slight and constant taper from the tip end to butt end. For example, co-pending U.S. application Ser. No. 09/005,559, entitled "Golf Club Shaft Having Contoured Grip Section and Kick Section," and filed Jan. 12, 1998, the specification of which is incorporated herein by reference, discloses a variety of contoured golf club shafts.

Figure 8:
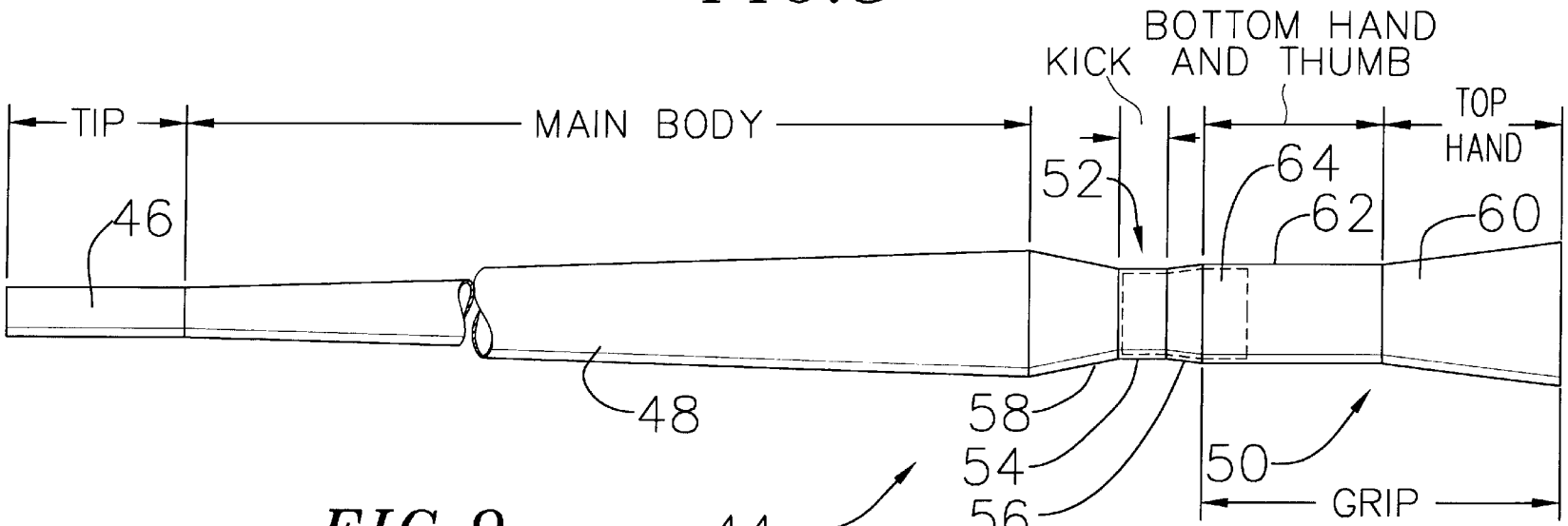
FIG. 8 is a side view of a golf club shaft including a vibration damping device in accordance with another preferred embodiment of the present invention.

One such contoured golf club shaft is illustrated in FIG. 8. Here, the shaft 44 includes a tip section 46, a main body section 48, a grip section 50 and a kick section 52 between the main body and grip sections. The kick section 52 is formed by an elongate substantially cylindrical section 54. The kick section is connected to the main body section 48 and the grip section 50 by the frusto-conically shaped connecting portions 56 and 58. The kick section 52 defines an OD that is less than the OD of the distal portion of the grip section 50 and that is also less than the largest OD of the main body section 48. This area is more flexible than the grip section and the proximal portion of the main body section. The grip section 50 includes a frusto-conically shaped tapered top hand portion 60 and a generally cylindrical bottom hand/bottom thumb portion 62 that provide a contour which is closer to the natural contour of the golfer's hands than clubs employing conventional shafts and/or conventional shaft/grip arrangements.

Exemplary shaft 44 also includes a vibration damping device 64 that has an exterior surface which conforms to the interior surface of shaft 44. More particularly, and as illustrated for example in FIG. 9, the vibration damping device 64 includes a first substantially cylindrical portion 66, a second substantially cylindrical portion 68 that is smaller than the first, and a generally frusto-conical portion 70 therebetween. In the illustrated embodiment, damping device 64 only occupies a portion of the bottom hand/bottom thumb portion 62. However, the damping device may be reconfigured such that it occupies all of the bottom hand/bottom thumb portion 62 and, if so desired, some or all of the top hand portion 60. The damping device may also be reconfigured such that it only occupies the top hand portion 60. The interior of the damping 64 corresponds to the damping devices described above with reference to FIGS. 1–6.

Figure 10:
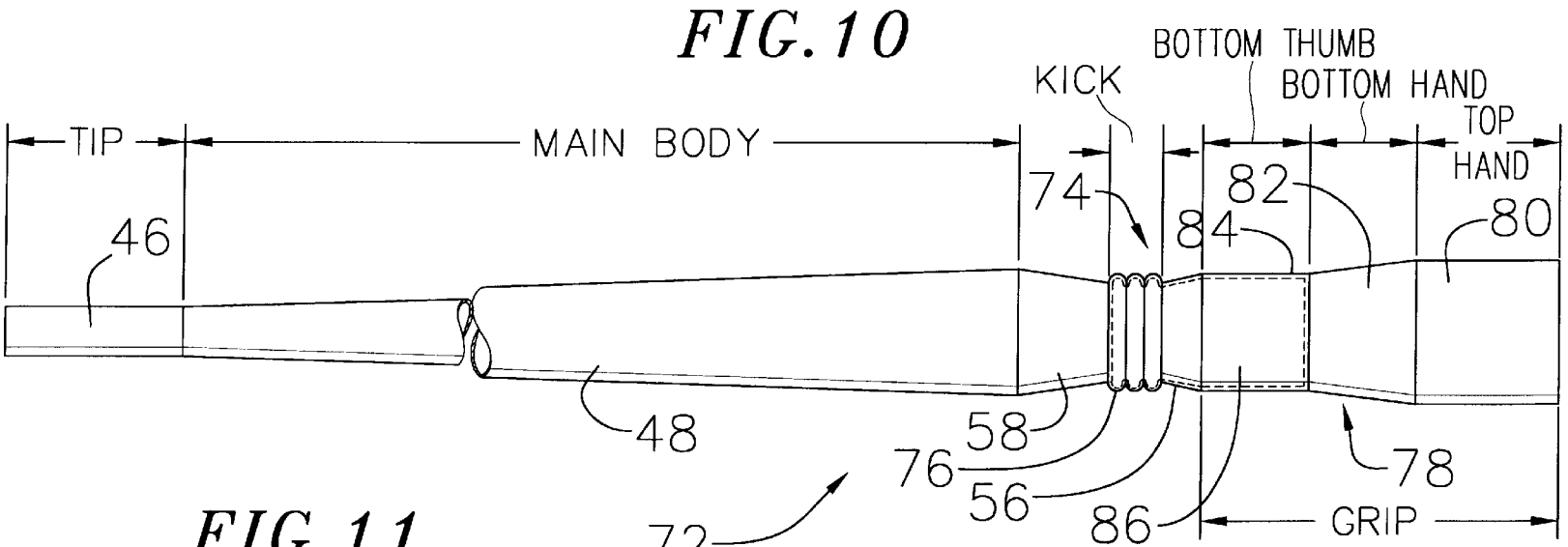
FIG. 10 is a side view of a golf club shaft including a vibration damping device in accordance with still another preferred embodiment of the present invention.

Turning to the exemplary shaft 72 shown in FIG. 10, the kick section 74 includes a plurality of ring-like protrusions 76. Each of the ring-like protrusions includes an area of larger OD and two areas of smaller OD. The shape of the interior portion of the shaft will substantially correspond to the shape of the exterior in the area of the protrusions 76. In other words, there will be a protruding surface on the interior when there is a protruding surface on the exterior and the thickness of the kick section will be substantially uniform over the length thereof. Additionally, the protrusions 76 may be positioned end to end, as shown, or there may be spacing therebetween. The protrusions may also be rounded, as shown, or have generally flat sides. The number of protrusions may vary from, for example, one to sixteen. The grip section 78 in this embodiment includes a substantially cylindrical top hand portion 80, a frusto-conically shaped tapered bottom hand portion 82, and a substantially cylindrical bottom thumb portion 84.

Figure 11:
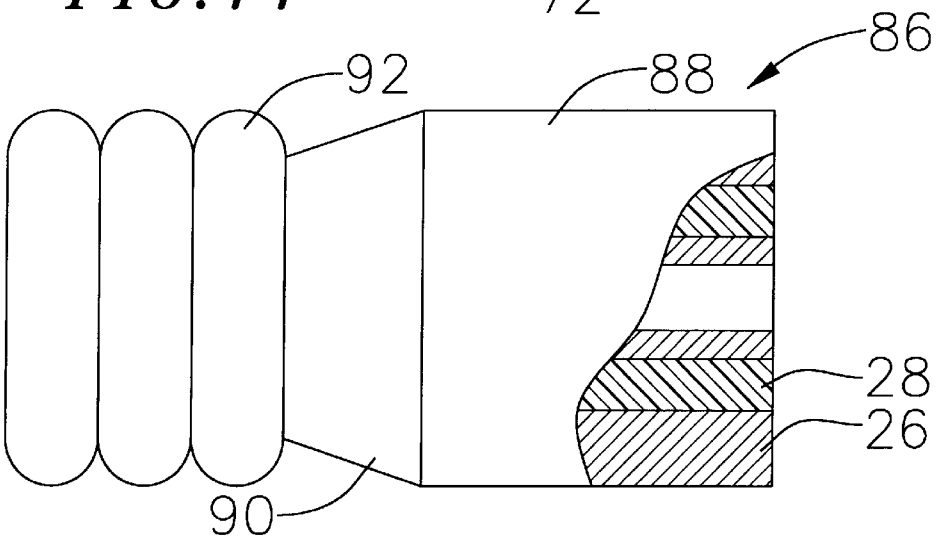
FIG. 11 is a side, partial section view of the vibration damping device shown in FIG. 10.

Exemplary shaft 72 also includes a vibration damping device 86 that has an exterior surface which conforms to the interior surface of shaft 72. As illustrated for example in FIG. 11, vibration damping device 86 includes a first substantially cylindrical portion 88, a generally frusto-conical portion 90, and a series of ring-like portions 92. Exemplary damping device 86 only occupies a portion of the bottom thumb portion 84. However, the damping device may be reconfigured such that it occupies some or all the bottom hand portion 82 and, if so desired, some or all of the top hand portion 80. The damping device may also be reconfigured such that it only occupies the top hand portion 80. The interior of the vibration damping device 86 corresponds to those described above with reference to FIGS. 1–6.

Figure 12:
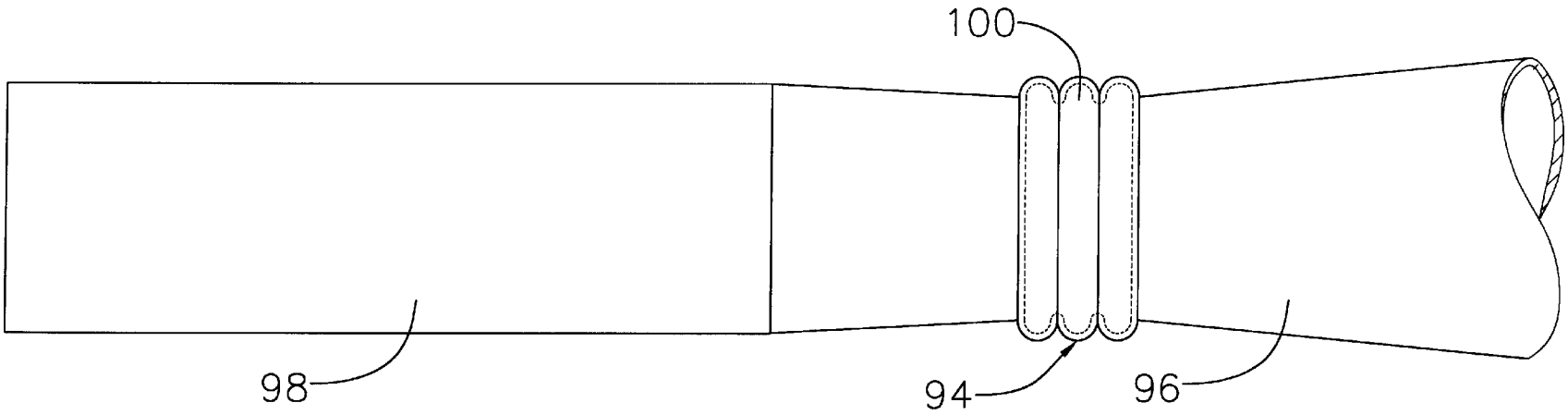
FIG. 12 is a partial side view of a golf club shaft including a vibration damping device in accordance with yet another preferred embodiment of the present invention.

As illustrated for example in FIG. 12, a kick section 94 may be provided in the main body section 96 of a shaft near the tip section 98. A vibration damping device 100 in accordance with the present invention may be located within the kick section 94 and preferably has an outer surface that conforms to the inner surface of the kick section. The interior of the vibration damping device 100 corresponds to those described above with reference to FIGS. 1–6.

With respect to materials, the elastic main body portion 26 is preferably formed from a viscoelastic polymer material, such as silicon rubber foam, which is relatively soft and has high memory properties. The damping members 28 are preferably cylindrically shaped rods formed from aluminum or other metal matrices. Of course, rods of other shapes and materials may be used. Preferably, the total weight of any of the vibration damping devices illustrated herein with be approximately 15 g or less.

Figure 9:
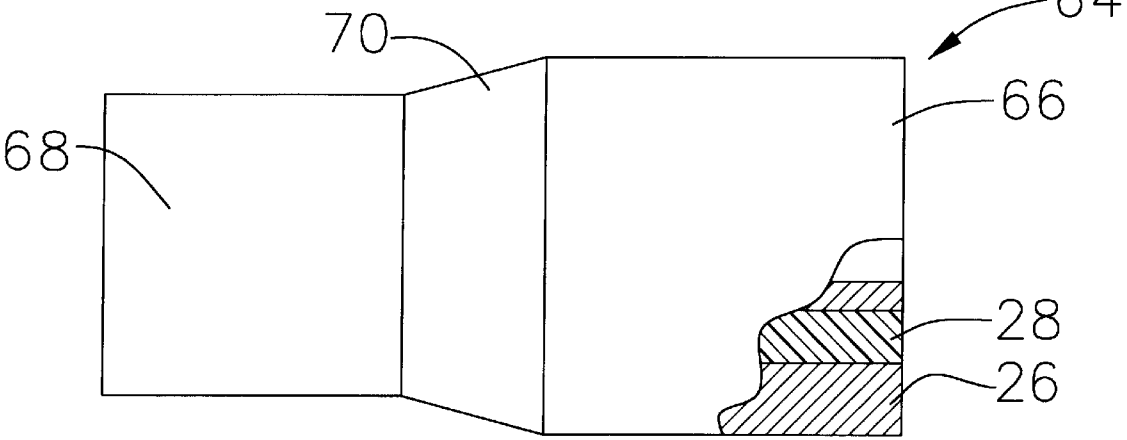
FIG. 9 is a side, partial section view of the vibration damping device shown in FIG. 8.

Turning to dimensions, vibration damping devices which are located in the vicinity of the grip section of the shaft are preferably between about 2 inches and about 7 inches in overall length. The length of a damping device which is located near the tip section is preferably between about 1 inch and about 7 inches and is located between about 3 inches from the tip end of the shaft and about 17 inches from the tip end. The outer diameter (OD) of the vibration damping device depends upon the inner diameter (ID) of the golf club or other device for striking an object that the vibration damping device is used in conjunction with. The OD of the damping device should be slightly larger than the ID of the device in which it is located to insure a tight press fit. For example, the OD of larger substantially cylindrical portion 66 of the vibration damping device shown in FIG. 9 is preferably about 0.85 inch, while the OD of the smaller substantially cylindrical portion is preferably about 0.75 inch. The ID of the air passage 34 is preferably about 0.25 inch.

Figure 13:
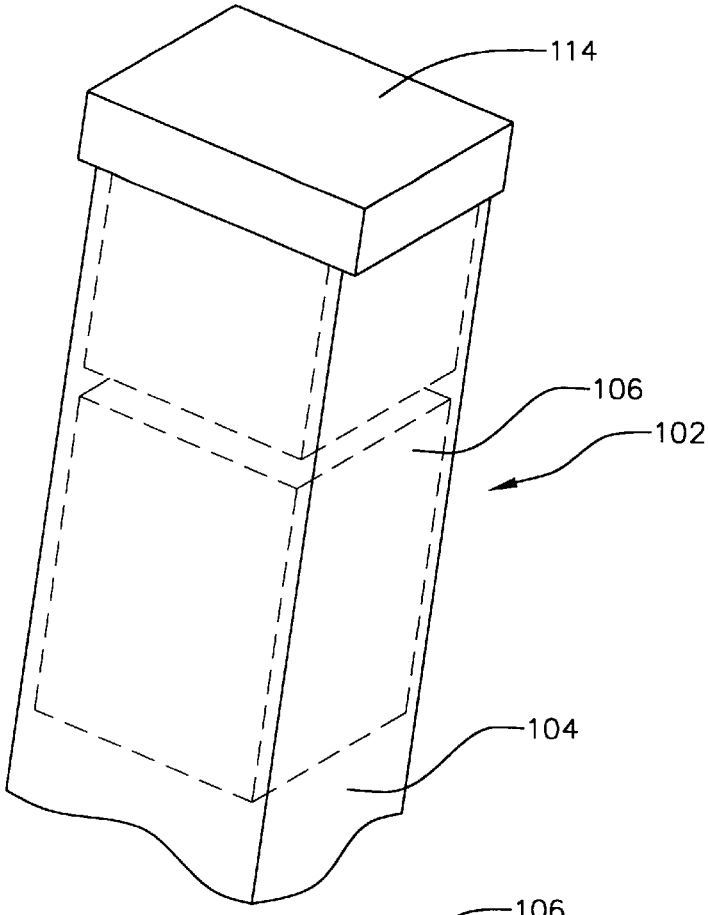
FIG. 13 is a partial perspective view of a tennis racket including a vibration damping device in accordance with a preferred embodiment of the present invention.
Figure 14:
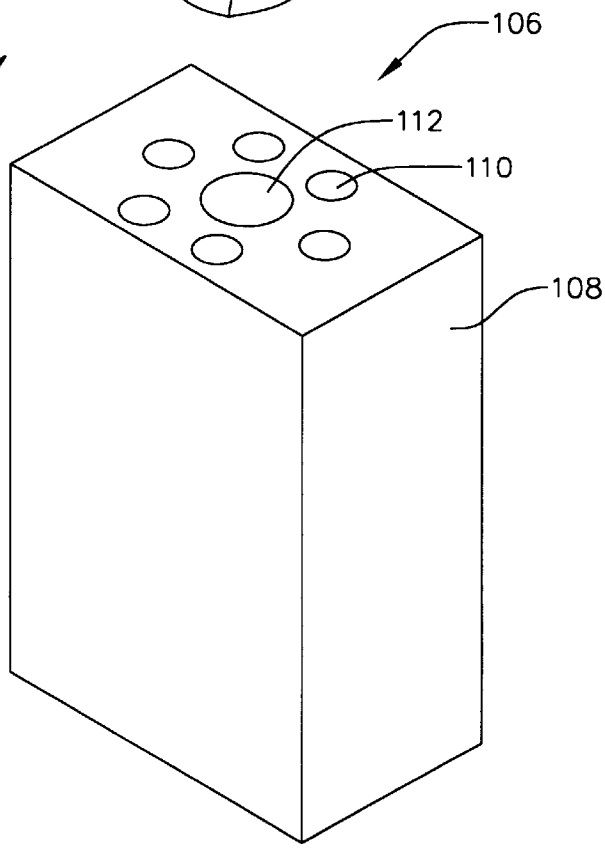
FIG. 14 is a perspective view of the vibration damping device shown in FIG. 13.
Figure 17:
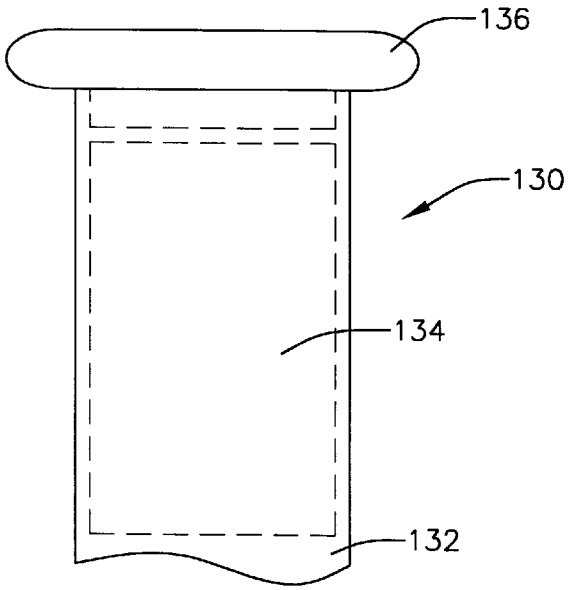
FIG. 17 is a partial side view of a baseball bat handle including a vibration damping device in accordance with a preferred embodiment of the present invention.
Figure 18:
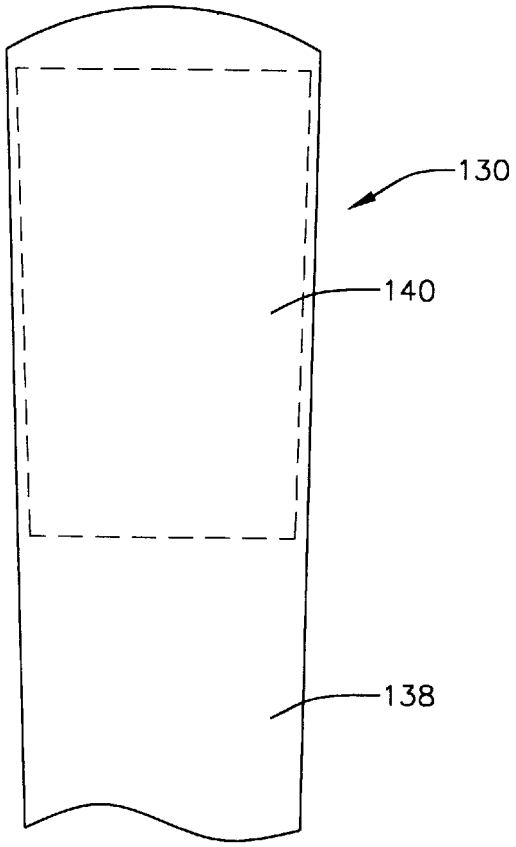
FIG. 18 is a partial side view of a baseball bat barrel including a vibration damping device in accordance with a preferred embodiment of the present invention.

As discussed above, application of the present invention is not limited to golf clubs. Referring to FIGS. 13 and 14, a vibration damping device in accordance with the present invention may also be included in the handle of a tennis racket 102. The hollow handle 104 includes a vibration damping device 106 which has an elastic main body portion 108 that is sized and shaped to fit within the tennis racket handle, a series of damping members 110 and an air passage 112. An end cap 114 closes the end of the handle 104. A hockey stick 116 in accordance with the present invention is shown in FIGS. 15 and 16. The hockey stick includes a hollow handle 118 having a vibration damping device 120 therein. The damping device has an elastic main body portion 122 that is sized and shaped to fit within the stick handle 118, a plurality of damping members 124 and an air passage 126. An end cap 128 is also provided. Turning to FIG. 17, the hollow handle 132 of a baseball bat 130 may include a vibration damping device 134. The exemplary handle also includes an end cap 136. Alternatively, or in addition, the barrel 138 of the baseball bat 130 may include a vibration damping device 140. Damping devices 134 and 140 are configured in the manner described heretofore.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A vibration damping device for use with an instrument having a hollow portion defining a inner surface of predetermined size, the vibration damping device comprising:

an elastic main body portion defining a longitudinal axis, first and second longitudinal ends, an outer surface and an outer surface size substantially equal to the size of the inner surface of the hollow portion of the instrument whereby the elastic main body portion can be placed within the hollow portion of the instrument such that the outer surface on the elastic main body portion engages the inner surface of the hollow portion of the instrument; and a plurality of elongate damping members, each of the damping members defining a longitudinal axis and an outer surface extending parallel to and around the longitudinal axis and first and second longitudinal end surfaces, the entire outer surface of each of the damping members being surrounded by and in contact with the elastic main body portion, and at least one of the damping members being radially spaced from the longitudinal axis of the elastic main body portion.

2. A vibration damping device as claimed in claim 1, wherein the elastic main body portion defines a longitudinally extending aperture and the aperture extends along the longitudinal axis.

3. A vibration damping device as claimed in claim 1, wherein the elastic main body portion defines an outer surface and the outer surface includes at least one indentation extending from the first longitudinal end to the second longitudinal end.

4. A vibration damping device as claimed in claim 1, wherein the elastic main body portion is formed from a viscoelastic material.

5. A vibration damping device as claimed in claim 1, wherein the longitudinal axis of each of the damping members is substantially parallel to the longitudinal axis of the elastic main body portion.

6. A vibration damping device as claimed in claim 1, wherein the damping members extend from the first longitudinal end of the elastic main body portion to the second longitudinal end of the elastic main body portion.

7. A vibration damping device as claimed in claim 6, wherein the first and second longitudinal end surfaces of the damping members are respectively flush with the first and second longitudinal ends of the elastic main body portion.

8. A vibration damping device as claimed in claim 1, wherein the plurality of damping members comprise at least three equally circumferentially spaced damping members.

9. A vibration damping device as claimed in claim 1, wherein at least one of the plurality of damping members defines a substantially cylindrical shape.

10. A vibration damping device as claimed in claim 1, wherein the elastic main body portion includes an outer surface defining a perimeter and has at least one indentation extending around the perimeter.

11. A vibration damping device as claimed in claim 1, wherein the elastic main body portion includes an outer surface and the outer surface defines a substantially cylindrical shape.

12. A vibration damping device as claimed in claim 1, wherein the elastic main body portion includes an outer surface and the outer surface includes, when in an uncompressed state, a first portion defining a generally cylindrical shape and a second portion defining a generally frusto-conical shape.

13. A vibration damping device as claimed in claim 1, wherein the vibration damping device comprises a cylindrical metal rod.

14. A vibration damping device for use with an instrument having a hollow portion, comprising:

an elastic main body portion defining a longitudinal axis and first and second longitudinal ends and including an outer surface having, when in an uncompressed state, a first portion defining a generally cylindrical shape, a second portion defining a generally frusto-conical shape, and a third portion defining a generally cylindrical shape, and the second portion being located between the first and third portions; and a plurality of damping members, each of the damping members having at least a portion thereof within the elastic main body portion and at least one of the damping members being radially spaced from the longitudinal axis of the elastic main body portion.

15. A golf club, comprising:

a shaft defining a substantially hollow interior; and a vibration damping device having at least at portion located within the hollow interior of the shaft, the vibration damping device including an elastic main body portion defining a longitudinal axis and first and second longitudinal ends, and a plurality of elongate damping members, each of the damping members defining a longitudinal axis and an outer surface extending parallel to and around the longitudinal axis and first and second longitudinal end surfaces, the entire outer surface of each of the damping members being surrounded by and in contact with the elastic main body portion, and at least one of the damping members being radially spaced from the longitudinal axis of the elastic main body portion.

16. A golf club as claimed in claim 15, wherein the elastic main body portion defines a longitudinally extending aperture and the aperture extends along the longitudinal axis.

17. A golf club as claimed in claim 15, wherein the elastic main body portion defines an outer surface and the outer surface includes at least one indentation extending from the first longitudinal end to the second longitudinal end.

18. A golf club as claimed in claim 15, wherein the elastic main body portion is formed from a viscoelastic material.

19. A golf club as claimed in claim 15, wherein the longitudinal axis of each of the damping members is substantially parallel to the longitudinal axis of the elastic main body portion.

20. A golf club as claimed in claim 15, wherein the damping members extend from the first longitudinal end of the elastic main body portion to the second longitudinal end of the elastic main body portion.

21. A golf club as claimed in claim 20, wherein the first and second longitudinal end surfaces of the damping members are respectively flush with the first and second longitudinal ends of the elastic main body portion.

22. A golf club as claimed in claim 15, wherein the plurality of damping members comprise at least three equally circumferentially spaced damping members.

23. A golf club as claimed in claim 15, wherein at least one of the plurality of damping members defines a substantially cylindrical shape.

24. A golf club as claimed in claim 15, wherein the elastic main body portion includes an outer surface defining a perimeter and has at least one indentation extending around the perimeter.

25. A golf club as claimed in claim 15, wherein the interior of the shaft defines a shape and the elastic main body portion includes an outer surface defining a shape corresponding to the shape of the interior of the shaft.

26. A golf club as claimed in claim 15, wherein the interior of the shaft includes a first portion defining a generally cylindrical shape and a second portion defining a generally frusto-conical shape and the elastic main body portion includes an outer surface having, when in an uncompressed state, a first portion defining a generally cylindrical shape and a second portion defining a generally frusto-conical shape.

27. A golf club as claimed in claim 26, wherein the interior of the shaft includes a third portion defining a generally cylindrical shape, the second portion being located between the first and third portions of the interior of the shaft, and the elastic main body portion includes, when in an uncompressed state, a third portion defining a generally cylindrical shape, the second portion being located between the first and third portions of the outer surface of the elastic main body portion.

28. A golf club as claimed in claim 15, wherein the vibration damping device comprises a cylindrical metal rod.

* * * * *